US007896342B2

(12) United States Patent
Tsukamoto et al.

(10) Patent No.: US 7,896,342 B2
(45) Date of Patent: Mar. 1, 2011

(54) SHEET SUPPLY APPARATUS, IMAGE FORMING APPARATUS, SHEET SUPPLY CONTROL METHOD, AND COMPUTER READABLE MEDIUM

(75) Inventors: Kazuyuki Tsukamoto, Kanagawa (JP); Shin Takeuchi, Kanagawa (JP); Minoru Ohshima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 332 days.

(21) Appl. No.: 11/517,586

(22) Filed: Sep. 8, 2006

(65) Prior Publication Data

US 2008/0012216 A1 Jan. 17, 2008

(30) Foreign Application Priority Data

Feb. 15, 2006 (JP) ..... 2006-037977

(51) Int. Cl.
*B65H 7/02* (2006.01)

(52) U.S. Cl. ..... 271/265.04; 271/263; 271/262; 271/122; 271/124; 271/125

(58) Field of Classification Search ..... 271/122, 271/124, 125, 264.04, 262, 263
See application file for complete search history.

(56) References Cited

U.S. PATENT DOCUMENTS 4,280,692 A * 7/1981 Hutchinson et al. ..... 271/160
4,385,335 A * 5/1983 Kiemer ..... 360/137
5,449,162 A * 9/1995 Saito et al. ..... 271/122
5,678,817 A * 10/1997 Saito et al. ..... 271/122
5,927,703 A * 7/1999 Endo ..... 271/10.03
6,234,470 B1 * 5/2001 Okitsu et al. ..... 271/114
6,299,156 B1 10/2001 Kaneda et al.
6,788,440 B1 * 9/2004 Sashida ..... 358/498
2002/0001105 A1 1/2002 Takaki et al.
2002/0074712 A1 6/2002 Yano
2004/0188916 A1 * 9/2004 Tsukamoto et al. ..... 271/110
2005/0184447 A1 8/2005 Tsukamoto et al.
2005/0258592 A1 * 11/2005 Mitsuya et al. ..... 271/258.01

FOREIGN PATENT DOCUMENTS

CN 1360233 A 7/2002
JP 05069972 A * 3/1993

(Continued)

*Primary Examiner*—Stefanos Karmis
*Assistant Examiner*—Ernesto Suarez
(74) *Attorney, Agent, or Firm*—Morgan, Lewis & Bockius LLP

(57) ABSTRACT

A sheet supply apparatus has a sheet storing part that stores sheets, a sheet transport part that feeds the sheets from the sheet storing part and transports the sheets, a sheet separating part that separates the sheets fed from the sheet storing part, a sheet thickness measuring part that measures a thickness of the sheets separated by the sheet separating part, a sheet separating strength varying part that causes the sheet separating part to apply one or more of a plurality of sheet separating strengths to separate the sheets, and a control part that controls the sheet separating strength varying part to cause the sheet separating part to apply, from among the plurality of sheet separating strengths, one or more sheet separating strengths, other than a weakest sheet separating strength, during a time period which begins upon a start of feed of the sheets.

8 Claims, 7 Drawing Sheets

FOREIGN PATENT DOCUMENTS

| | | | |
|---|---|---|---|
| JP | 08119479 A | * | 5/1996 |
| JP | 09-67036 | | 3/1997 |
| JP | 09-188430 | | 7/1997 |
| JP | 11-292307 | | 10/1999 |
| JP | 2002-002992 | | 1/2002 |
| JP | A-2005-82340 | | 3/2005 |

* cited by examiner

SHEET SUPPLY APPARATUS, IMAGE FORMING APPARATUS, SHEET SUPPLY CONTROL METHOD, AND COMPUTER READABLE MEDIUM

BACKGROUND

1. Technical Field

The present invention relates to a sheet feeding apparatus for separating and transporting sheets one at a time and an image forming apparatus equipped with this.

2. Related Art

In order to form a high-quality image on a recording sheet in an image forming apparatus which uses an electrophotographic method or an ink-jet method, an image forming process needs to be executed with appropriate parameters corresponding to the thickness, material, and so on of the recording sheet. For example, in order to suitably transfer a toner image formed on a photosensitive body to a recording sheet using an electrophotographic system, a transfer bias of the strength needs to be set corresponding to the thickness, material, and so on of the recording sheet. In an ink-jet system, the ink ejection patterns need to be changed in accordance with the thickness, material, and so on of the recording sheet.

Generally, recording sheets are placed in a sheet tray as a sheaf of plural stacked sheets, and sheets are separated one at a time from this sheaf of sheets and transported to an image forming portion. However, it sometimes happens that two sheets are transported at the same time due to the friction created between sheets (known as double-feeding). To prevent this kind of double feeding, a method is adopted in which a separating roller is provided to a position opposing a transporting roller, paper being separated one sheet at a time by rotating the separating roller in the same direction as the transporting roller.

In this case, the distance between the transporting roller and the separating roller needs to be adjusted in accordance with the thickness of the recording sheet. Further, to prevent skewing and jamming of the recording sheet, it is also effective to adjust the contact pressure when sandwiching the recording sheet between the transporting roller and the separating roller, in accordance with the thickness of the recording sheet. In order to perform these adjustments, the thickness of the recording sheet transported to the image forming portion needs to be measured ahead of the image forming process.

SUMMARY

According to an aspect of the present invention, there is provided a sheet supply apparatus including: a sheet storing part that stores sheets; a sheet transport part that feeds the sheets from the sheet storing part and transports the sheets; a sheet separating part that separates the sheets fed from the sheet storing part; a sheet thickness measuring part that measures a thickness of the sheets separated by the sheet separating part; a sheet separating strength varying part that causes the sheet separating part to apply one or more of a plurality of sheet separating strengths to separate the sheets; and a control part that controls the sheet separating strength varying part to cause the sheet separating part to apply, from among the plurality of sheet separating strengths, one or more sheet separating strengths, other than a weakest sheet separating strength, during a time period which begins upon a start of feed of the sheets.

BRIEF DESCRIPTION OF THE DRAWINGS

Exemplary embodiments of the present invention will be described in detail based on the following figures, wherein.

DETAILED DESCRIPTION

Figure 1:
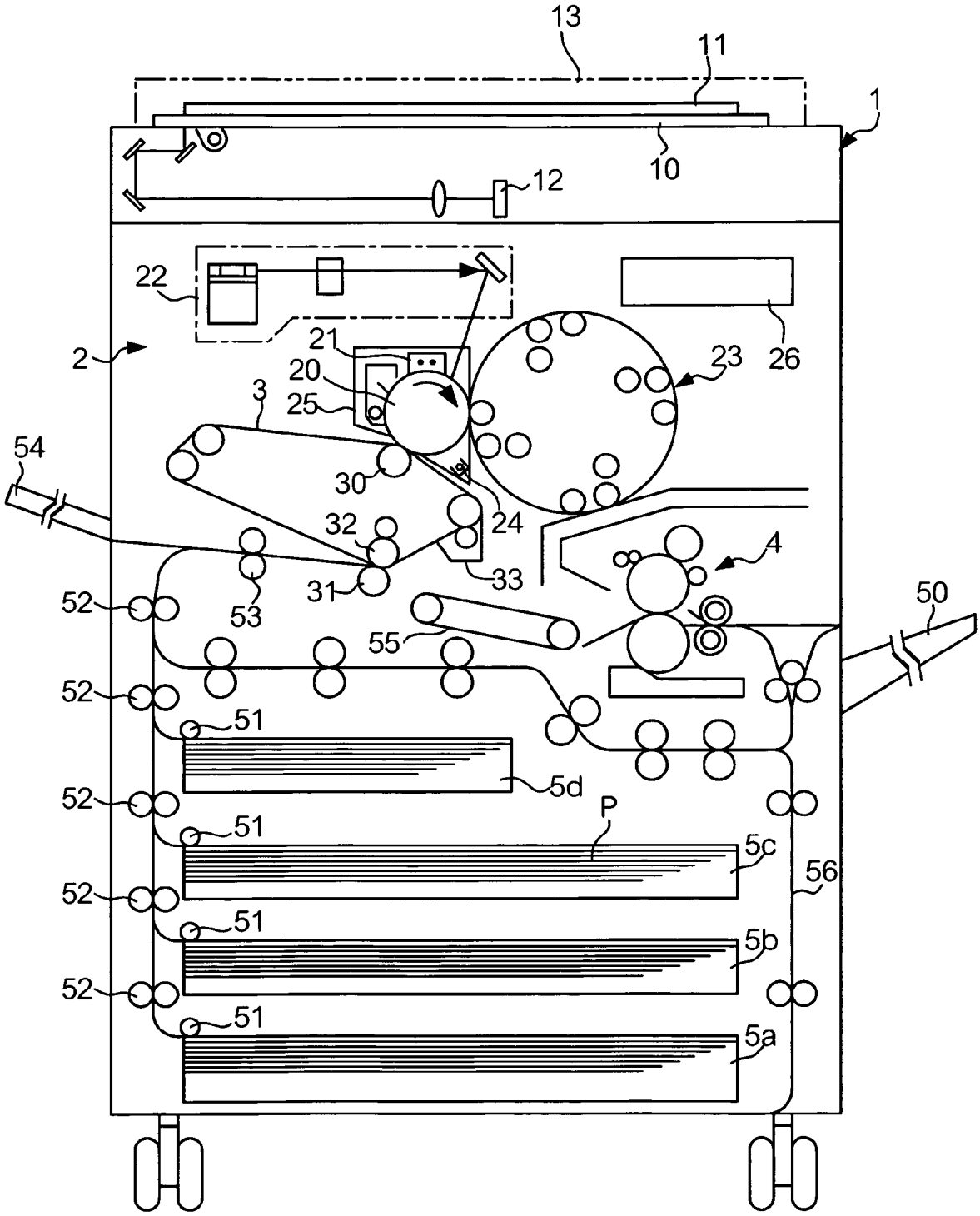
FIG. 1 is a schematic view showing an example of a digital color copier to which a sheet feeding apparatus of the present invention may be applied.

FIG. 1 is a cross-section view showing a constitution of a digital color copier, which is an image forming apparatus with a built-in sheet feeding apparatus according to the exemplary embodiment of the present invention. This copier is provided with an image input portion 1 for optically reading an image on a document 11 placed on a platen glass 10 and converting it to electric image data using a CCD sensor 12, and an image forming portion 2 for forming an image on a recording sheet P based on the image data transferred from the image input portion 1.

The image forming portion 2 forms an image on the recording sheet P by forming a toner image on a photosensitive drum 20 based on the image data transferred from the image input portion 1, and then performing first image transfer of the toner image to an endless intermediate image transfer belt 3, and further performing second image transfer of the toner image on the intermediate image transfer belt 3 to the recording sheet P. The recording sheet P onto which the toner image underwent second image transfer is ejected onto an ejection sheet tray 50 after passing through a fixing device 4. Specifically, the photosensitive drum 20 rotates in the direction of the arrow at a prescribed process speed, and around it are disposed a charge corotron 21 for uniformly charging a surface of the photosensitive drum 20 up to a prescribed background potential, a laser beam scanner 22 for forming an electrostatic latent image on the photosensitive drum 20 by exposing the photosensitive drum 20 using a laser beam modulated based on the image data, a rotary developer unit 23 having black, yellow, magenta, and cyan color developing devices for developing the electrostatic latent image on the photosensitive drum using one of the developing devices, an image transfer pre-processing corotron 24 for removing the potential from the photosensitive drum 20 ahead of first image transfer of the toner image to the intermediate image transfer belt 3, and a cleaner 25 for removing residual toner on the photosensitive drum 20 after first image transfer of the toner image is complete.

The intermediate image transfer belt 3 is stretched across multiple rollers and rotates in the direction of the arrow, the color toner images formed sequentially on the photosensitive drum 20 are transferred onto the intermediate image transfer belt 3 in an overlaid fashion, and then undergo second image transfer in a batch to the recording sheet P from the intermediate image transfer belt 3. A first image transfer roller 30 for forming an image transfer electric field between the intermediate image transfer belt 3 and the photosensitive drum 20 is disposed in a position opposing the photosensitive drum 20 sandwiching the intermediate image transfer belt 3, while a second image transfer roller 31 and an opposing electrode roller 32 are disposed sandwiching the intermediate image transfer belt 3 at a position of second image transfer of the toner image, and the recording sheet P receives image transfer of the toner image when passing between the second image transfer roller 31 and the intermediate image transfer belt 3. Along the rotating path of the intermediate image transfer belt 3, a belt cleaner 33 for eliminating paper dust and residual toner from the surface of the intermediate image transfer belt 3 which has finished second image transfer is provided between the second image transfer position and the first image transfer position.

Sheet trays 5*a* to 5*d* in four levels which store the recording sheets P of different sizes are provided below the image forming portion 2. A recording sheet P of an appropriate size corresponding to the document size detected by the image input portion 1 is sent to the image forming portion 2 from one of the sheet trays by a pick-up roller 51. Multiple sheet transporting rollers 52 are disposed along the transporting path of the recording sheet P from the sheet trays 5*a* to 5*d* until reaching the second image transfer position of the toner image. A sheet registration roller 53 is disposed upstream in the transporting direction of the second image transfer position. The sheet registration roller 53 sends the recording sheet P sent from the sheet trays 5*a* to 5*d* to the second image transfer position at a prescribed timing synchronized with the timing of writing the electrostatic latent image on the photosensitive drum 20.

Note that in FIG. 1, reference numeral 13 is a platen glass, reference numeral 26 is an image processing portion for supplying image data transferred from the image input portion 1 to the image forming portion 2 to the laser beam scanner 22 after processing it according to the type of copying being done, reference numeral 54 is a manual sheet tray used during manual sheet feeding of recording sheets P, reference numeral 55 is a sheet transporting belt for transporting the recording sheet P onto which the toner image has undergone second image transfer to the fixing device 4, and reference numeral 56 is an inverter path for inverting the recording sheet P and transporting it to the second image transfer position from the fixing device 4 when performing double-sided copying of the recording sheet P.

With a color copier of the exemplary embodiment of the present invention constituted as described above, the laser beam scanner 22 exposes the photosensitive drum 20 based on the image information of the document read by the image input portion 1, and the electrostatic latent image corresponding to black is written to the photosensitive drum 20 first. At the same time, the black toner developing device is set to a position opposing the photosensitive drum 20 in the rotary developer unit 23, and the electrostatic latent image is developed by the black developing device slightly after the writing timing. The black toner image formed in this way undergoes first image transfer onto the intermediate image transfer belt 3 by the first image transfer roller 30, and the intermediate image transfer belt 3 rotates, holding the toner image as is. When the developing step by the black developing device is complete, the developing units switch while the intermediate image transfer belt 3 finishes one rotation cycle, and the yellow toner developing unit is set to a position opposing the photosensitive drum 20 by a 90° rotation of the rotary developing unit 23. These operations are repeated during one rotation cycle of the intermediate image transfer belt 3 thereafter, with the yellow, magenta, and cyan toner images transferred to the intermediate image transfer belt 3 from the photosensitive drum 20 each time, and the toner image being formed on the intermediate image transfer belt 3 through overlaying of the toner images of the four colors. A full-color overlaid transferred toner image formed in this way undergoes second image transfer to the recording sheet P sent from the sheet registration roller 53 in the prescribed timing, and the recording sheet P to which the unfixed toner image has been transferred passes through the fixing device 4 and is ejected into the ejection sheet tray 50.

Figure 2:
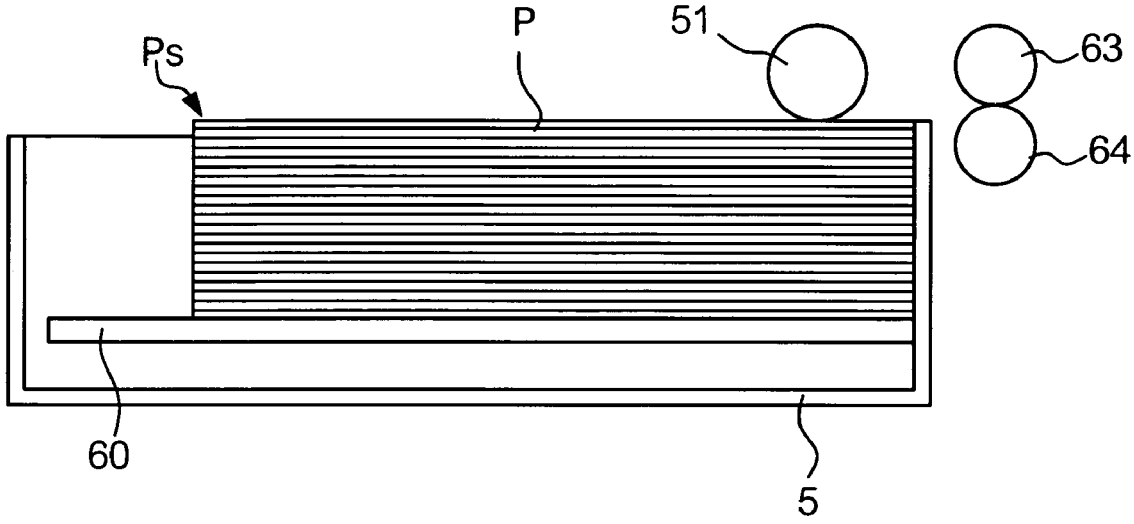
FIG. 2 is a schematic view showing a constitution of the sheet feeding apparatus.

Next, FIG. 2 is a view showing a specific constitution of the sheet tray (sheet trays 5*a* to 5*d*).

The sheet tray 5 is formed in an approximately rectangular shape provided with a storage area for the recording sheets P, and is constituted such that the recording sheets P can be inserted from a front side (the side in front of the paper in FIG. 1) into the copier casing constituting a sheet feeding portion. The recording sheets P are loaded into the sheet tray 5 and a bottom plate 60 is provided for raising the recording sheets P upwards. The pick-up roller 51 is provided corresponding to the front edge of the recording sheet P positioned in the sheet tray 5 on the copier casing side into which the sheet tray 5 is inserted, and when the recording sheet P is raised by the rising of the bottom plate 60, the front edge of the recording sheet P positioned topmost in the sheet tray 5 presses against the pick-up roller 51. Due to this, when the pick-up roller 51 rotates, a prescribed friction force acts between the recording sheet P and the pick-up roller 51, and the topmost recording sheet P is pulled out of the sheet tray 5. At the same time, in order to prevent transporting multiple overlaid sheets of the recording sheets P which are pulled out of the sheet tray 5 (double-feeding), a transporting roller 63 and a separating roller 64 are provided adjacent to the pick-up roller 51 on the copier casing side.

Figure 3:
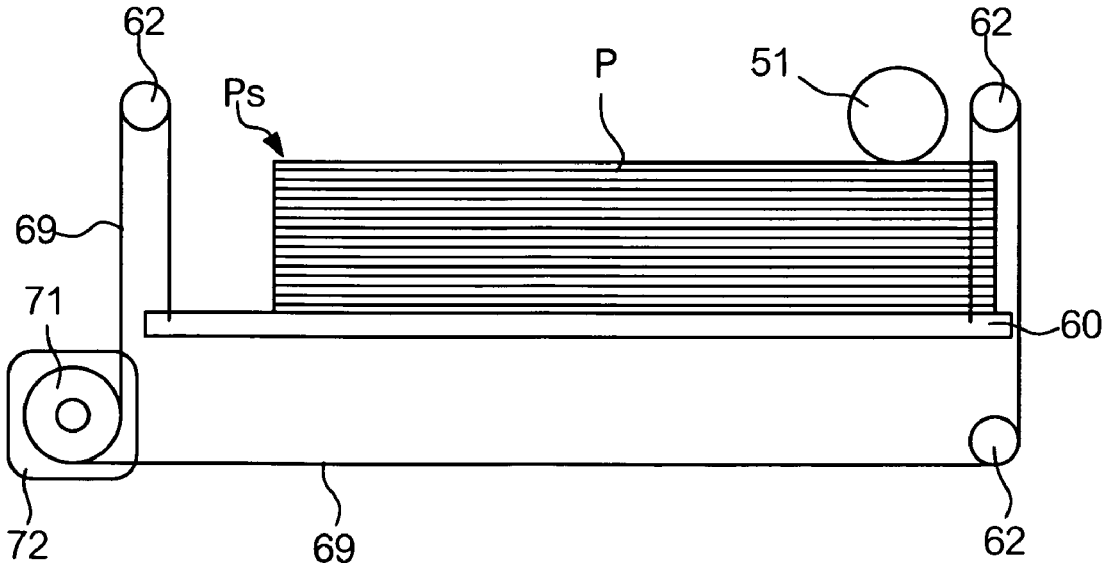
FIG. 3 is a schematic view showing a lift-up mechanism of a bottom plate.

Next, FIG. 3 is a view showing a mechanism for raising and lowering the bottom plate 60.

A wire 69 which is looped around a pulley 62 is linked to the bottom plate 60, and when the wire 69 is wound by a winding pulley 71 which is linked to a lift-up motor 72, the bottom plate 60 rises inside the sheet tray 5 and the topmost recording sheet P makes contact with the pick-up roller 51. The winding pulley 71 is constituted so as to be linked to the lift-up motor 72 when the sheet tray 5 is pushed into the copier casing, and then separated from the lift-up motor 72 when the sheet tray 5 is pulled out of the copier casing. For this reason, when the sheet tray 5 is pulled out of the apparatus casing, the bottom plate 60 descends to the bottom surface of the sheet tray 5 due to its own weight, allowing a user easily to fill the recording sheets P. When the sheet tray 5 is detected by an unillustrated sensor as being completely pushed into the copier casing, the lift-up motor 72 is driven and the wire 69 is wound in preparation for feeding the recording sheets P, and the bottom plate 60 is raised until the topmost recording sheet P in the sheaf of sheets loaded on the bottom plate 60 touches the pick-up roller 51.

Further, the pick-up roller 51 is movably disposed vertically, and gradually descends as the number of recording sheets P loaded on the bottom plate 60 decreases through sheet feeding. In order to maintain the pick-up roller 51 at approximately the same height level as the transporting roller 63, an unillustrated sensor detects when the pick-up roller 51 descends to a prescribed height level through continuous sheet feeding, and the lift-up motor 72 is constituted so as to be driven for a prescribed amount of time, triggered by a change in the output signal of this sensor. Through this, the bottom plate 60 rises only by an amount equal to the thickness of the recording sheets P which have been fed, and the topmost recording sheet P in the sheet tray 5 comes in contact with the pick-up roller 51 always at the prescribed height.

With this type of photoelectric copier, in particular color copiers which perform overlay image transfer of toner images of many colors onto a recording sheet P, an ideal image transfer bias needs to be applied to the second image transfer roller 31 which corresponds to the thickness of the recording sheet P, and if the image transfer bias applied is inappropriate, retransfers due to faulty transfer of the toner image or inverted polarity of the toner occur, making it impossible to form a high-quality image. In order to prevent double-feeding of the recording sheets P during sheet feeding of the recording sheets P from the sheet tray 5, it is desired to optimize the contact pressure of the separating roller 64 on the transporting roller 63 in accordance with the thickness of the recording sheets P. For this reason, in this copier, the thickness of the recording sheets P set in the sheet tray 5 is learned, and the second image transfer bias of the toner image, the contact pressure of the separating roller 64, and more are optimized in accordance with the learned thickness of the recording sheets P.

Figure 4:
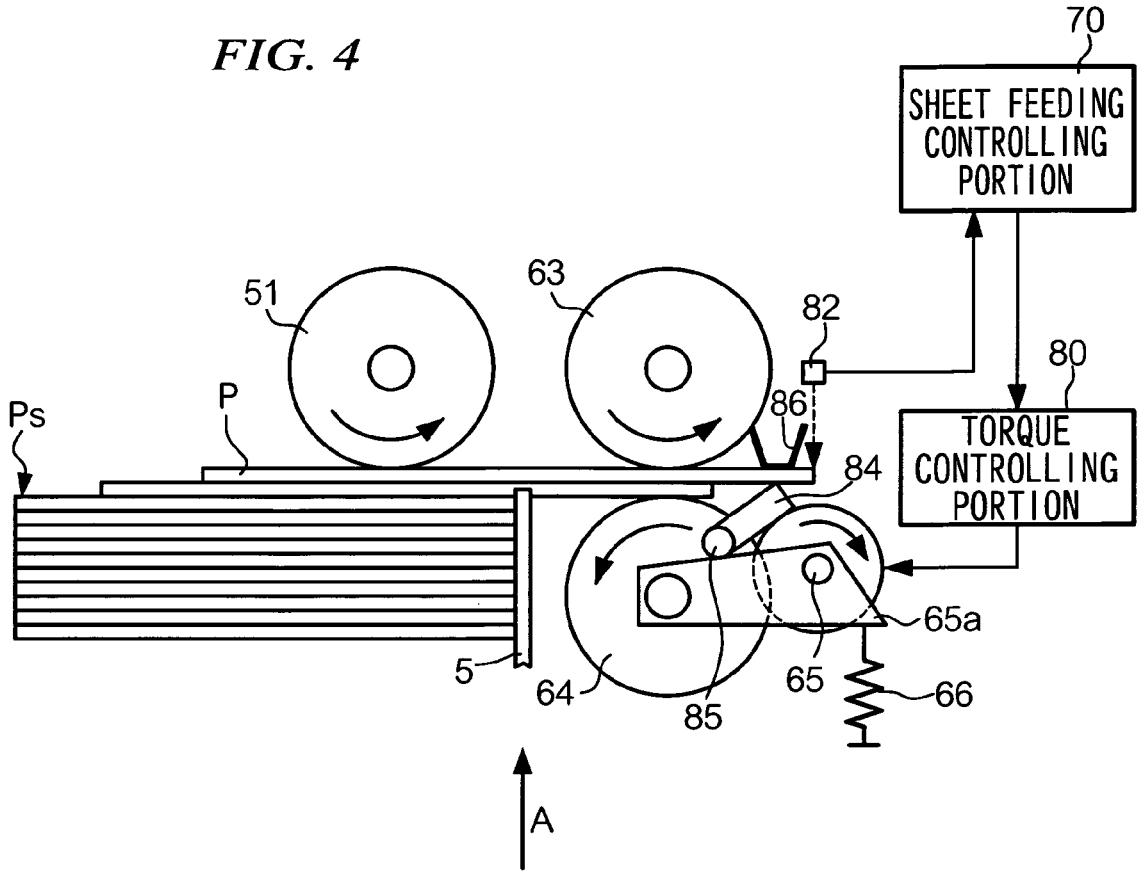
FIG. 4 is an expanded view showing a mechanism in the vicinity of a transporting roller and a separating roller.
Figure 5:
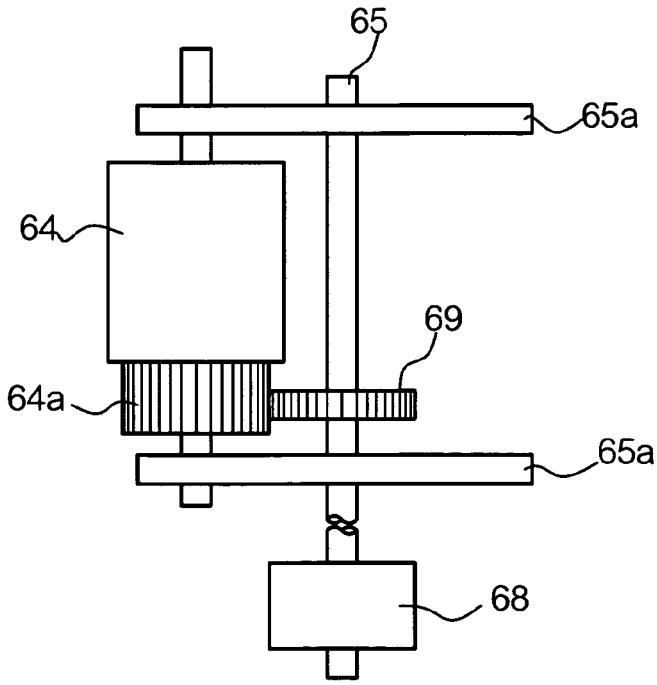
FIG. 5 is a plan view showing the mechanism in the vicinity of the transporting roller and the separating roller.

Next, FIG. 4 is an expanded view of a mechanism for pulling the recording sheets P out of the sheet tray 5 and separating them one at a time. FIG. 5 is a plan view seen from the direction of the arrow A in FIG. 4.

In FIG. 4, a sheet feeding controlling portion 70 controls rotation of the pick-up roller 51 and the transporting roller 63, and performs a sheet feeding operation of the recording sheets P set in the sheet tray 5. A sheet detecting sensor 82 is provided downstream of the transporting roller 63 in the transporting direction. The front edge of the recording sheet P separated from the sheet sheaf Ps in the sheet tray 5 and passed through the transporting roller 63 and a nip portion of the separating roller is detected by the sheet detecting sensor 82. When the sheet detecting sensor 82 detects the front edge of the recording sheet P, the sheet feeding controlling portion 70 moves the pick-up roller 51 upward in the drawing, and moves the pick-up roller 51 away from the surface of the topmost recording sheet P in the sheet tray 5. Thereafter, the recording sheet P is transported to the right in the drawing by the transporting roller 63 under control by the sheet feeding controlling portion 70.

The transporting roller 63 and the separating roller 64 are provided to mutually opposing positions. The transporting roller 63 transports a sheet touching a cylindrical surface to the right in the drawing by rotating the cylindrical surface around a shaft. The separating roller 64 is supported at one end by a pivotably provided arm 65*a* around a supporting shaft 65. The arm 65*a* pivots around the supporting shaft 65 either in a direction in which the cylindrical surface of the separating roller 64 presses against the cylindrical surface of the transporting roller 63 or in the opposite direction. An elastic member 66 is linked to the other end of the arm 65*a*, and the separating roller 64 is biased upward by the elastic force (a downward force in the drawing) of the elastic member, and its cylindrical surface is pressed against the cylindrical surface of the transporting roller 63. The transporting roller 63 and the pick-up roller 51 are rotationally driven by a common feed DC motor (not shown), while the separating roller 64 is linked to a drive shaft of a DC motor 68 via a torque limiter (not shown), and is rotationally driven in the same direction as the transporting roller 63. In other words, the separating roller 64 is rotationally driven in a direction such that a force in the opposite direction of the sheet transporting direction is applied to the recording sheet P. However, if more than a prescribed torque acts on the separating roller 64, it rotates in the opposite direction from the transporting roller 63. In other words, it rotates in a direction such that a force is applied to the sheet in the same direction as the transporting direction of the recording sheet P.

A rod-shaped contact member 84 is a sheet thickness measuring member, with one end pivotably supported by a shaft 85 and another end touching a receiving portion 86. When the recording sheet P moves between the transporting roller 63 and the separating roller 64 and furthermore moves between the contact member 84 and the receiving portion 86, the contact member 84 pivots downward in the drawing according to the thickness of the recording sheet P. With this pivoting, a signal generating device (not shown) such as a potentiometer generates an output signal corresponding to the pivot angel of the contact member 84 (i.e., the thickness of the recording sheet P), and provides this signal to the sheet feeding controlling portion 70. The sheet feeding controlling portion 70 can specify the thickness of the recording sheet P by analyzing this output signal.

In order to completely prevent double-feeding of the recording sheets P, the strength of the separating action by the separating roller 64 can be adjusted according to the thickness and so on of the recording sheets P being used. As shown in FIG. 5, a gear 69 is affixed to the supporting shaft 65, and the drive shaft of the DC motor 68 is linked. A torque controlling portion 80 can freely change the rotational torque of the DC motor 68, and rotationally drives the DC motor 68 through rotational torque based on an instruction from the sheet feeding controlling portion 70. When the supporting shaft 65 and the gear 69 are rotated by this, this rotation is transmitted to a gear 64*a* affixed to the shaft of the separating roller 64, and the separating roller 64 rotates. In other words, the rotational torque generated by the DC motor 68 can be transmitted to the separating roller 64 via the gears 69 and 64*a*. Accordingly, by adjusting this rotational torque, the strength of the separating action by the separating roller 64 can be freely adjusted. In this way, the recording sheets P pulled out of the sheet tray 5 are separated one sheet at a time when passing through the nip formed by the transporting roller 63 and the separating roller 64, and the sheet feeding operation can be performed in a stable fashion.

When a user performs a copy job and the sheet tray 5 to be used during that job is selected automatically or manually, the sheet feeding controlling portion 70 measures the thickness of the recording sheet P to be used in that job, and sets the image transfer bias corresponding to the thickness of the recording sheet P to an image transfer bias power supply 78. Through this, an image transfer bias of an optimum strength corresponding to the recording sheet P can be applied when performing second image transfer of the toner image from the intermediate image transfer belt 3 to the recording sheet P, making it possible to prevent faulty transfer of the toner image or retransfer.

Next, two operation examples of the sheet feeding apparatus are described.

In the first example, a sheet feeding apparatus can change the strength of the separating action by the separating roller 64 in two levels. Below, sheet separation with a strong separating action is called "strong separation," and sheet separation with a weak separating action is called "weak separation." A "strong separation" setting is a setting in which the rotation torque generated by a DC motor 68 is highest within a range in which sheet feeding of a recording sheet P is possible by a transporting roller 63. When instructed to begin transporting the recording sheet P, the sheet feeding controlling portion 70 instructs the torque controlling portion 80 such that strong separation of the two levels of separating action is realized throughout the period from the start of transportation until a prescribed number of recording sheets P is transported, and the torque controlling portion 80 adjusts the rotational torque of the separating roller 64 in accordance with this instruction. Once the prescribed number of recording sheets P from the start of transportation is finished being transported, the sheet feeding controlling portion 70 instructs the torque controlling portion 80 such that weak separation of the two levels of separating action is realized, and the torque controlling portion 80 adjusts the rotational torque of the separating roller 64 in accordance with this instruction.

Figure 6:
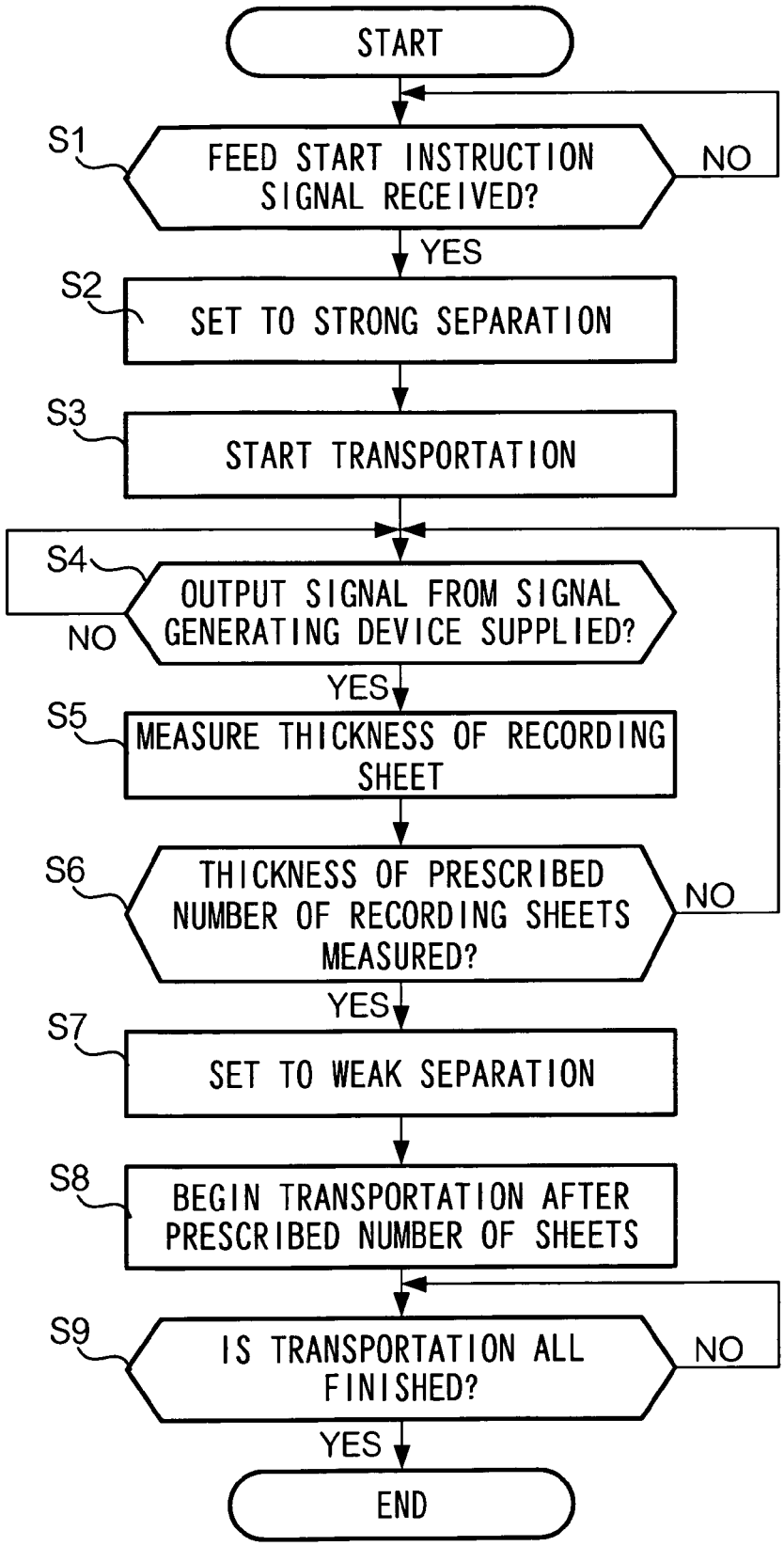
FIG. 6 is a flowchart showing an operation of a sheet feeding controlling portion.

FIG. 6 is a flowchart showing a procedure executed by the sheet feeding controlling portion 70.

When the sheet feeding controlling portion 70 receives a sheet feeding start instruction signal from a main controlling portion, which is not shown, and receives an instruction to begin transporting the recording sheets P (step S1: Yes), the separating action by the separating roller 64 is set to "strong separation," and the setting is stored in an internal memory (step S2). The torque controlling portion 80 rotationally drives the DC motor 68 with a large rotational torque according to this setting. With this, the separating action of the separating roller 64 becomes large.

Next, the sheet feeding controlling portion 70 begins a sheet feeding operation (step S3), and determines whether or not an output signal is supplied from a signal generating device such as a potentiometer in accordance with a pivot angle of the contact member 84 (step S4). An output signal being supplied to the sheet feeding controlling portion 70 from the signal generating device (step S4: Yes) means that the recording sheet P has reached the position of a sheet thickness measuring part (between the contact member 84 and the receiving portion 86). The sheet feeding controlling portion 70 measures the thickness of the recording sheet P by analyzing this output signal (step S5).

Next, the sheet feeding controlling portion 70 determines whether or not the thickness of all the prescribed number (e.g., 10 sheets) of the recording sheets P has been measured from the start of the transportation of the recording sheets P (step S6). Here, the reason for measuring the thickness of the prescribed number of recording sheets P is to measure the thickness of multiple recording sheets P and average that in order to arrive at a more accurate thickness. Accordingly, the sheet feeding controlling portion 70 repeats the process of steps S4 to S6 until all the prescribed number (10) of recording sheets P from the beginning of the transportation of the recording sheets P is measured (step S6: No).

When the prescribed number (10) of recording sheets P from the beginning of the transportation of the recording sheets P passes the position of the sheet thickness measuring part and the thicknesses are all measured (step S6: Yes), the sheet feeding controlling portion 70 sets the separating action of the separating roller 64 to "weak separation," and further sets this to a strength of separating action according to the thickness of the recording sheets P (the average thickness of 10 sheets) within a setting range for weak separation (step S7). The sheet feeding controlling portion 70 instructs the torque controlling portion 80 such that the strength of separating action which has been set is realized. In accordance with this instruction, the torque controlling portion 80 rotationally drives the DC motor 68 with a relatively weak rotational torque in accordance with the thickness of the recording sheet P. In other words, the separating action of the separating roller 64 is small, and at a strength in accordance with the thickness of the recording sheet P.

After this, the sheet feeding controlling portion 70 begins transporting the recording sheets P after the prescribed number of sheets with this weak separation (step S8), and determines whether or not the number of recording sheets P instructed by the sheet feeding start instruction signal has finished being transported (step S9). Once all the transportation is complete (step S9: Yes), the operation of the sheet feeding controlling portion 70 finishes.

Below follows a description of the second operation example.

This second operation example shares with the first operation example the fact that the strength of separating action by the separating roller 64 can be changed in two levels by the sheet feeding apparatus, but differs from the first operation example in the fact that when an instruction is given to begin transporting the recording sheets P, the torque of the separating roller 64 is adjusted to "strong separation" until the thickness of the first recording sheet P is measured, and thereafter set to "weak separation."

Figure 7:
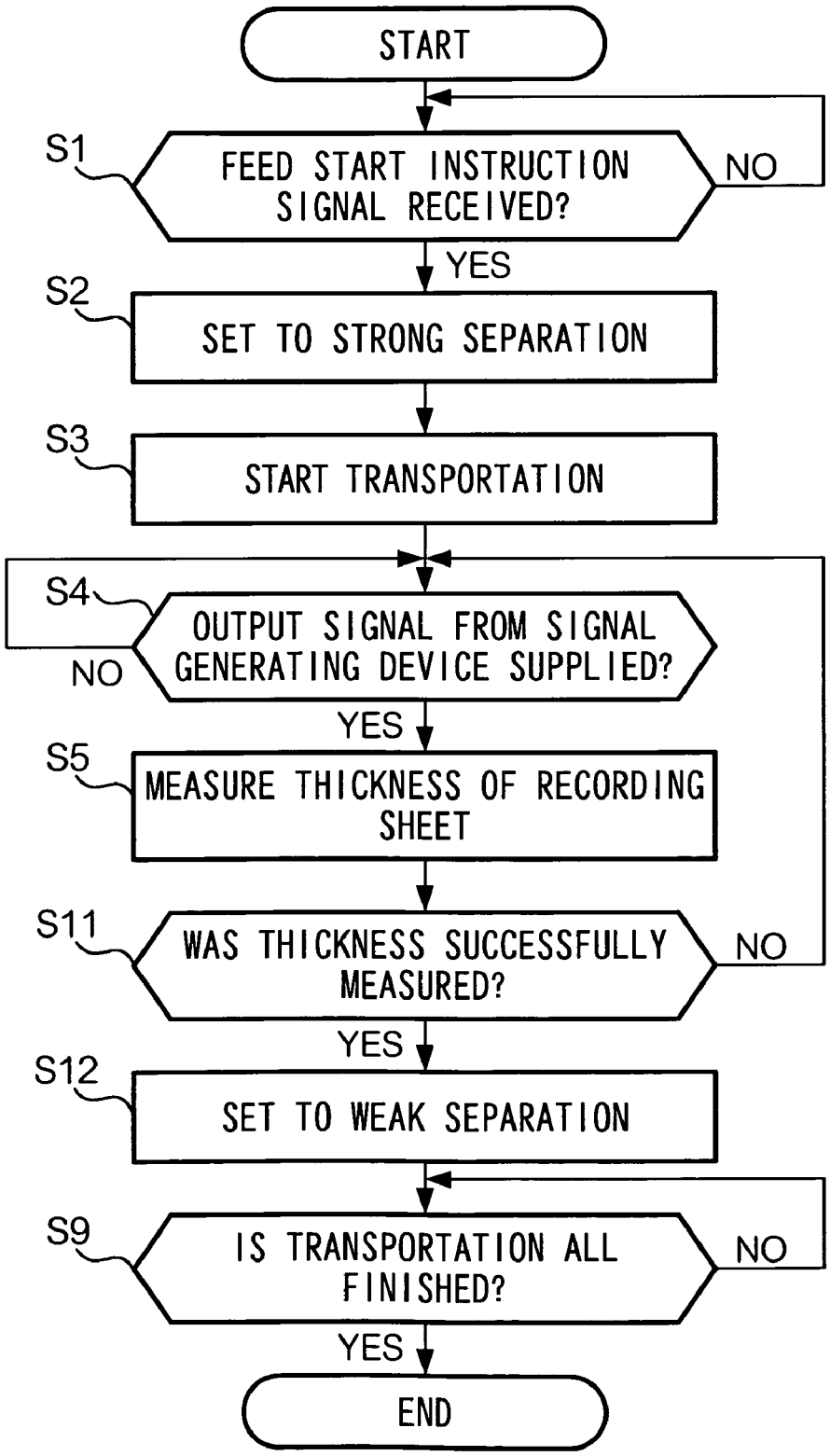
FIG. 7 is a flowchart showing an operation of the sheet feeding controlling portion.

FIG. 7 is a flowchart showing a procedure executed by the sheet feeding controlling portion 70, and the same reference numerals are used for the same processes in FIG. 6.

When the sheet feeding controlling portion 70 receives a sheet feeding start instruction signal from a main controlling portion, which is not shown, and receives an instruction to begin transporting the recording sheets P (step S1: Yes), the separating action by the separating roller 64 is set to "strong separation," and the setting is stored in an internal memory (step S2). The torque controlling portion 80 rotationally drives the DC motor 68 with a large rotational torque according to this setting. With this, the separating action of the separating roller 64 becomes large.

Next, the sheet feeding controlling portion 70 begins a sheet feeding operation (step S3), and determines whether or not an output signal is supplied from a signal generating device such as a potentiometer in accordance with a pivot angle of the contact member 84 (step S4). An output signal being supplied to the sheet feeding controlling portion 70 from the signal generating device (step S4: Yes) means that the recording sheet P has reached the position of a sheet thickness measuring part (between the contact member 84 and the receiving portion 86). The sheet feeding controlling portion 70 attempts to measure the thickness of the recording sheet P by analyzing this output signal (step S5).

The sheet feeding controlling portion 70 then determines whether or not measurement of the thickness of the recording sheet P was successful (step S11). If the measurement of the thickness of the recording sheet P was successful (step S11: Yes), then the sheet feeding controlling portion 70 sets the separating action by the separating roller 64 to "weak separation," and further makes a setting in accordance with the thickness of the recording sheet P within a setting range of the weak separation (step S12). The sheet feeding controlling portion 70 instructs the torque controlling portion 80 such that the strength of separating action which has been set is realized. In accordance with this instruction, the torque controlling portion 80 rotationally drives the DC motor 68 with a relatively weak rotational torque in accordance with the thickness of the recording sheet P. In other words, the separating action of the separating roller 64 is small, and at a strength in accordance with the thickness of the recording sheet P. After this, this sheet feeding controlling portion 70 continues transporting the recording sheets P with the weak separation, and determines whether or not the number of recording sheets P instructed by the sheet feeding start instruction signal has finished being transported (step S9). Once all the transportation is complete (step S9: Yes), operation of the sheet feeding controlling portion 70 finishes.

If the separating action by the separating roller 64 is inadequate when weak separation is set, multiple recording sheets P enter between the transporting roller 63 and separating roller 64, making it impossible to accurately measure the thickness of one recording sheet P. However, setting the separating action of the recording sheets P by the transporting roller 63 and the separating roller 64 to a stronger level will cause greater friction resistance to act on the transporting roller 63, the separating roller 64 and the recording sheets P, thus not only requiring excessive torque in driving the transporting roller 63, but also causing early wear of the rollers. Accordingly, in the first operation example and the second operation example described above, the separating action is set to strong separation only in cases in which the object is to measure the thickness of the recording sheets P. With this strong operation, the separating action is sufficiently strong, and therefore multiple sheets do not project downstream from the nip portion of the transporting roller 63 and the separating roller 64. After the thickness of the recording sheet P is finished being measured, the contact pressure of the separating roller 64 with respect to the thickness of the recording sheet P is optimized within the setting range of weak separation.

The above exemplary embodiments may be varied as follows.

For example, the first operation example and the second operation example can be combined. Specifically, strong separation can be set until the thickness of the recording sheets P is measured for sets of a prescribed number of sheets. For example, if the prescribed number of sheets is 10 sheets, the sheet feeding controlling portion 70 executes the processes of steps S2, S3, S4, S5, S11, and S12 shown in FIG. 7 for every set of 10 recording sheets P transported. In this case, the prescribed number of sheets may be 1 sheet. In this way, when the thickness is measured by transporting all the recording sheets P to be transported until their thickness is measured, the remaining sheets of the recording sheets P are transported with weak separation.

Moreover, the levels of the strength of separating action are not limited to two levels, and more levels may be provided, making it possible to change from weak strength to strong strength without levels.

When measuring the thickness of the recording sheets P, there is no need to use the separating action with the strongest strength. Simply put, when measuring the thickness of the recording sheets P, a strength other than that of the weakest separating action, of the multiple levels which can be set (one example being the strongest strength), may be set.

Figure 8:
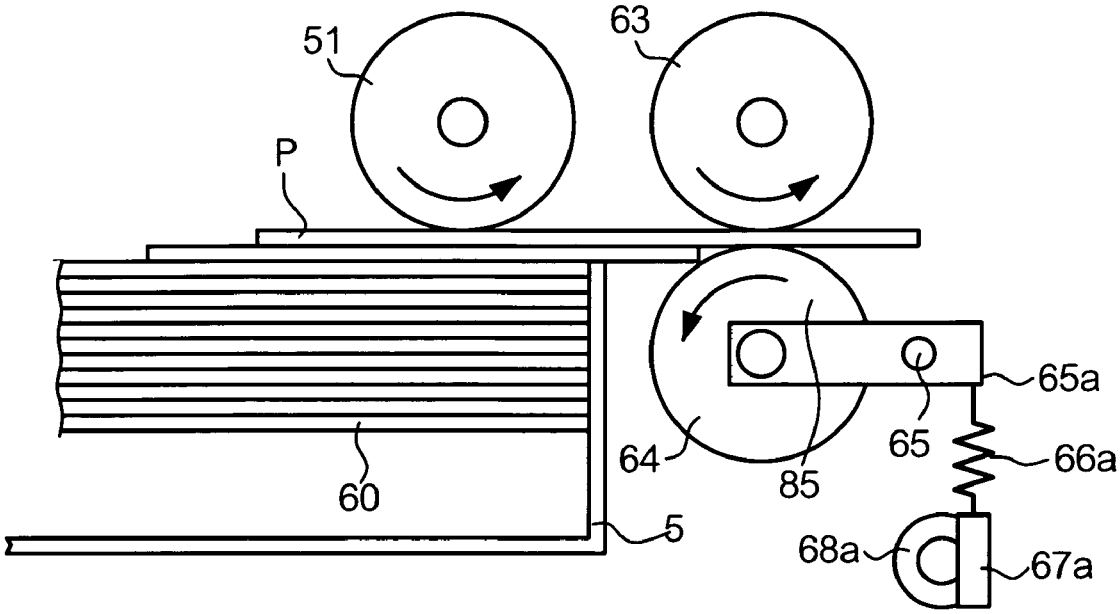
FIG. 8 is a view showing a constitution for applying strength from a separating action on recording sheets to the separating roller.

In order to make it possible to adjust the separating action by the separating roller 64, a constitution may be used in which rotational torque is applied to the separating roller 64 as described above in a direction which is opposite the transporting direction of the recording sheets P, and this rotational torque is adjusted. Another possibility is changing the contact pressure of the transporting roller 63 on the separating roller 64. Specifically, as shown in FIG. 8, the separating roller 64 is supported by the arm 65*a* pivotably provided around the supporting shaft 65, and presses against the transporting roller 63 by the bias force of an elastic member 66*a* which is linked to one end of the arm 65*a*. An actuator rod 67*a* is connected to one end of the elastic member 66*a*, and when the actuator rot 67*a* is moved by rotating an adjusting motor 68*a*, the bias created by the elastic member 66*a* is changed, and the contact pressure of the separating roller 64 on the transporting roller 63 can be freely adjusted. The recording sheets P pulled out from the sheet tray 5 are separated one sheet at a time when passing through the nip formed by the transporting roller 63 and the separating roller 64.

The sheet thickness measuring part may be constituted as follows.

Figure 9:
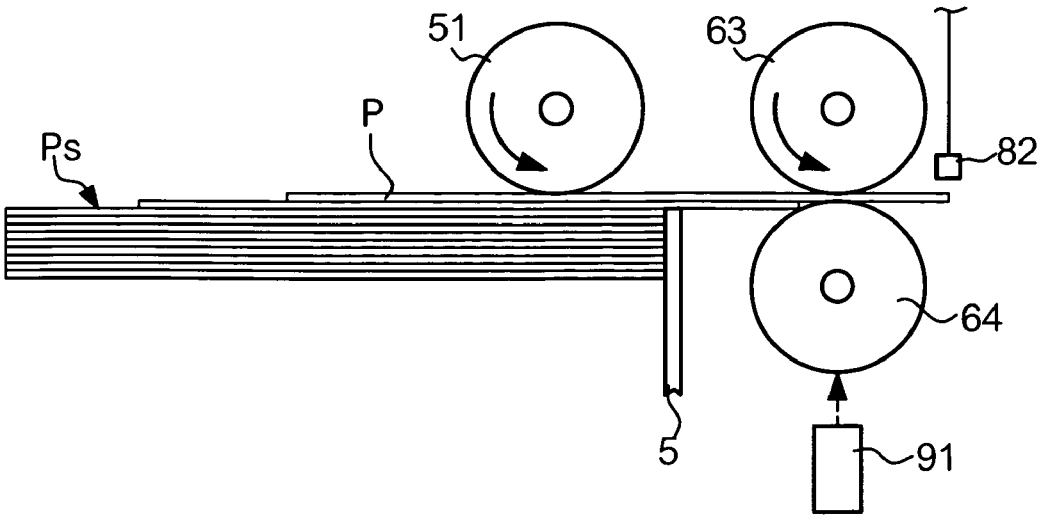
FIG. 9 is a view showing a modification of a sheet thickness measuring part.

FIG. 9 shows another constitution of the sheet thickness measuring part. In the example shown in FIG. 4, the sheet thickness measuring part directly measures the thickness of the recording sheet P pulled in between the transporting roller 63 and the separating roller 64, but in the example shown in FIG. 9, the constitution is such that the displacement amount of the separating roller 64 which is pushed down by the thickness of the recording sheet P is measured by a non-contact type laser displacement meter 91.

Figure 10:
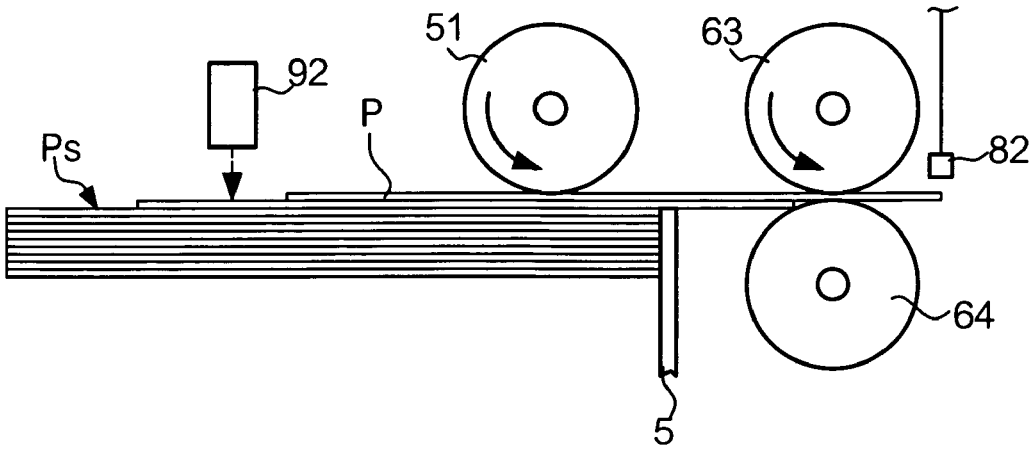
FIG. 10 is a view showing a modification of a sheet thickness measuring part.

FIG. 10 shows yet another constitution of the sheet thickness measuring part. In this example, a laser displacement meter 92 is provided above the sheet tray 5, the height of the sheaf of sheets Ps in the sheet tray 5 is measured before and after pulling the front edge portion of the recording sheet P in between the transporting roller 63 and the separating roller 64, and the thickness of one recording sheet P is measured from the displacement amount of the height.

Figure 11:
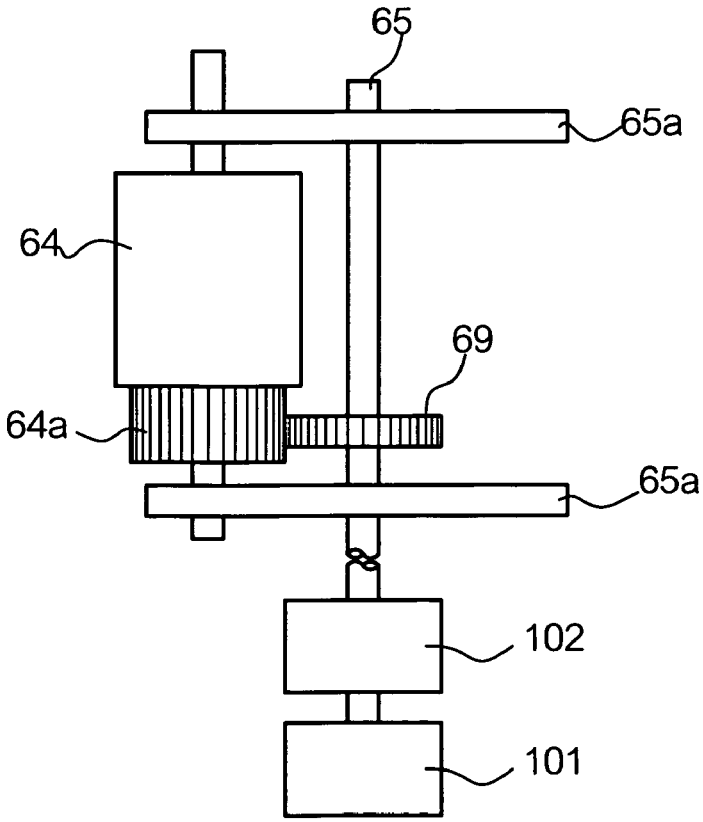
FIG. 11 is a view showing a modification of a constitution for applying strength from a separating action on recording sheets to the separating roller.

Furthermore, adjustment of the separating action can be realized using a stepping motor 101 and an electromagnetic clutch 102 as shown in FIG. 11 in lieu of the DC motor. In other words, the strength of the separating action can be changed by having the torque controlling portion 80 control the electromagnetic clutch 102 such that the torque which is transmitted from the stepping motor 101 to the separating roller 64 can be changed.

The sheet feeding controlling portion 70 may also be made to measure the thickness of a prescribed number of sheets as in the first operation example, with respect to the recording sheets P which are transported first after checking the opening and closing of the sheet tray 5 with an unillustrated sensor. Moreover, the sheet feeding controlling portion 70 may also be made to measure the thickness as in the second operation example, with respect to the first recording sheet P which is transported after checking the opening and closing of the sheet tray 5 with an unillustrated sensor. This is because the sheet tray 5 being opened or closed indicates a possibility that the type of recording sheet P set in the sheet tray 5 has been changed, and requires resetting the image transfer parameters and so on of the toner image in accordance with the thickness of the recording sheets P after the change.

Similarly, the sheet feeding controlling portion 70 may also be made to measure the thickness of a prescribed number of sheets as in the first operation example, with respect to the recording sheets P which are transported first after measuring that the door to the copier casing which leads to the image forming portion 2 has been opened or closed on the basis of an output signal from an interlock switch. Furthermore, the sheet feeding controlling portion 70 may also be made to measure the thickness as in the second operation example, with respect to the first recording sheet P which is transported after measuring that the door to the copier casing which leads to the image forming portion 2 has been opened or closed on the basis of the output signal from the interlock switch. The door to the copier casing being opened or closed indicates a possibility that a jamming operation of the recording sheets P has been performed, and it is therefore possible that the contact force of the separating roller 64 on the transporting roller 63 has not been optimized for the thickness of the recording sheets P, and as a result double-feeding of the recording sheets P or some other type of problem has occurred. If the opening and closing of the door to the copier casing is used as a timing for measuring the thickness of the recording sheets P, multiple repetitions of the opening and closing of the door during the same copy job or print job may be used as a condition.

Note that a program executed by the sheet feeding controlling portion 70 may be recorded on a recording medium capable of being read by a computer, such as a magnetic storage medium, an optical storage medium, or a ROM, and provided to the sheet feeding controlling portion 70. It is also possible to download such a program to the sheet feeding controlling portion 70 via a network such as the Internet.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet supply apparatus comprising:

a sheet storing part that stores sheets;

a sheet transport part that feeds the sheets from the sheet storing part and transports the sheets;

a sheet separating part that separates the sheets fed by the sheet transport part from the sheet storing part;

a sheet thickness measuring part disposed downstream of the sheet separating part and in the conveying path of the sheets that measures a thickness of individual sheets separated by the sheet separating part;

a sheet separating strength varying part that causes the sheet separating part to apply one or more of a plurality of sheet separating strengths to separate the sheets; and a control part that controls the sheet separating strength varying part to cause the sheet separating part to apply, from among the plurality of sheet separating strengths, one or more sheet separating strengths, other than a weakest sheet separating strength, during a start of an initial time period during which a predetermined number of the sheets is transported by the sheet transport part, after the first sheet of the predetermined number of sheets is measured by the sheet thickness measuring part during the initial time period, the control part controls the sheet separating strength varying part to cause the sheet separating part to apply a sheet separating strength based on the thickness of the first sheet of the predetermined number of sheets, and upon completion of the initial time period, the control part controls the sheet separating strength varying part to cause the sheet separating part to apply another sheet separating strength based on an average thickness of the predetermined number of sheets separated by the sheet separating part.

2. The sheet supply apparatus according to claim 1, wherein the control part controls the sheet separating strength varying part to cause the sheet separating part to apply, from among the plurality of sheet separating strengths, one or more sheet separating strengths, other than a weakest sheet separating strength, during the initial time period which begins upon any one of, attachment of a sheet tray to the sheet storing part, recovery of a sheet jam, or entry by a user of a request for measurement of a thickness of one of the sheets separated by the sheet separating part, and ends when a predetermined number of the sheets has been transported by the sheet transport part, whereby the sheet separating strength varying part causes the sheet separating part to apply a sheet separating strength based on the thickness of the average thickness of the predetermined number of sheets during a second time period beginning after the initial time period ends.

3. The sheet supply apparatus according to claim 1, wherein the sheet separating part comprises:

a transporting roller, provided at a set position on a sheet transporting path, that transports a sheet in contact with a cylindrical surface of the transporting roller along the sheet transport path upon rotation of the transporting roller about a shaft; and a separating roller, provided to closely oppose the transporting roller at the set position on the sheet transporting path, that is rotatable in a same direction as a rotating direction of the transporting roller when pressed against the transporting roller.

4. An image forming apparatus comprising:

the sheet supply apparatus according to claim 1; and an image forming unit that forms an image on a sheet supplied from the sheet supply apparatus.

5. A sheet supply control method for controlling sheet supply actions performed by a sheet supply apparatus, the method comprising:

providing a sheet supply apparatus having, a sheet storing part that stores sheets, a sheet transport part that feeds the sheets from the sheet storing part and transports the sheets, a sheet separating part that separates the sheets fed by the sheet transport part from the sheet storing part, a sheet thickness measuring part disposed downstream of the sheet separating part and in the conveying path of the sheets that measures a thickness of individual sheets separated by the sheet separating part, and a sheet separating strength varying part that causes the sheet separating part to apply one or more of a plurality of sheet separating strengths to separate the sheets; and controlling the sheet separating strength varying part to cause the sheet separating part to apply, from among the plurality of sheet separating strengths, one or more sheet separating strengths, other than a weakest sheet separating strength, during a start of an initial time period during which a predetermined number of the sheets is transported by the sheet transport part, after the first sheet of the predetermined number of sheets is measured by the sheet thickness measuring part during the initial time period, controlling the sheet separating strength varying part to cause the sheet separating part to apply a sheet separating strength based on the thickness of the first sheet of the predetermined number of sheets, and upon completion of the initial time period, controlling the sheet separating strength varying part to cause the sheet separating part to apply another sheet separating strength based on an average thickness of the predetermined number of sheets separated by the sheet separating part.

6. The sheet supply control method according to claim 5, comprising:

controlling the sheet separating strength varying part to cause the sheet separating part to apply, from among the plurality of sheet separating strengths, one or more sheet separating strengths, other than a weakest sheet separating strength, during the initial time period which begins upon any one of, attachment of a sheet tray to the sheet storing part, recovery of a sheet jam, or entry by a user of a request for measurement of a thickness of one of the sheets separated by the sheet separating part, and ends when a predetermined number of the sheets has been transported by the sheet transport part; and controlling the sheet separating strength varying part to cause the sheet separating part to apply a sheet separating strength based on the thickness of the average thickness of the predetermined number of sheets during a second time period beginning after the initial time period ends.

7. A non-transitory computer readable storage medium for storing a program causing a computer installed in a sheet supply apparatus to execute one or more programs, the one or more programs comprising instructions to:

control a sheet separating strength varying part of the sheet supply apparatus to cause a sheet separating part to apply, from among the plurality of sheet separating strengths, one or more sheet separating strengths, other than a weakest sheet separating strength, during a start of an initial time period during which a predetermined number of the sheets is transported by a sheet transport part, after the first sheet of the predetermined number of sheets is measured at a location downstream from the sheet separating part by a sheet thickness measuring part during the initial time period, control the sheet separating strength varying part to cause the sheet separating part to apply a sheet separating strength based on the thickness of the first sheet of the predetermined number of sheets, and upon completion of the initial time period, control the sheet separating strength varying part to cause the sheet separating part to apply another sheet separating strength based on an average thickness of the predetermined number of sheets separated by the sheet separating part.

8. A non-transitory computer readable storage medium for storing a program wherein the one or more programs comprises instructions to:

control the sheet separating strength varying part to cause the sheet separating part to apply, from among the plurality of sheet separating strengths, one or more sheet separating strengths, other than a weakest sheet separating strength, during the initial time period which begins upon any one of, attachment of a sheet tray to a sheet storing part, recovery of a sheet jam, or entry by a user of a request for measurement of a thickness of one of the sheets separated by the sheet separating part, and ends when a predetermined number of the sheets has been transported by the sheet transport part; and control the sheet separating strength varying part to cause the sheet separating part to apply a sheet separating strength based on the thickness of the average thickness of the predetermined number of sheets during a second time period beginning after the initial time period ends.

* * * * *